United States Patent [19]

Jordan

[11] 4,111,330

[45] Sep. 5, 1978

[54] RECLOSABLE VACUUM CONTAINER

[75] Inventor: Thomas F. Jordan, Oak Park, Ill.

[73] Assignee: The Continental Group, Inc., New York, N.Y.

[21] Appl. No.: 847,108

[22] Filed: Oct. 31, 1977

[51] Int. Cl.[2] ..... B65D 41/16

[52] U.S. Cl. ..... 220/306; 220/260; 220/270; 220/319; 220/358; 220/359

[58] Field of Search ..... 220/260, 270, 306, 319, 220/354–359, 378; 215/10, 253, 341, 352

[56] References Cited

U.S. PATENT DOCUMENTS

| | | | |
|---|---|---|---|
| 3,460,701 | 8/1969 | Powalowski et al. | 215/10 |
| 3,680,731 | 8/1972 | Lelyk et al. | 220/319 |

*Primary Examiner*—George T. Hall

*Attorney, Agent, or Firm*—Charles E. Brown

[57] ABSTRACT

A container which may be formed of sheet material in a conventional manner of forming cans and the like and wherein the container is suitable for sealing under a vacuum and is readily openable and reclosable in the manner of a Mason jar. The container includes a body defining a peripheral sealing cavity in which a formed in situ gasket is permanently retained.

18 Claims, 8 Drawing Figures

FIG.1
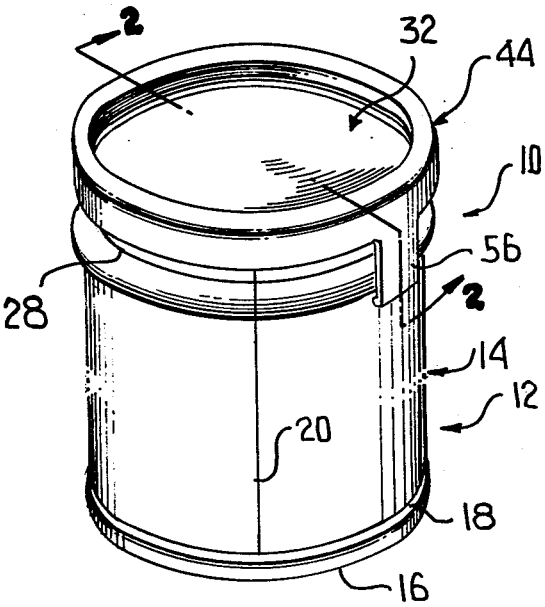
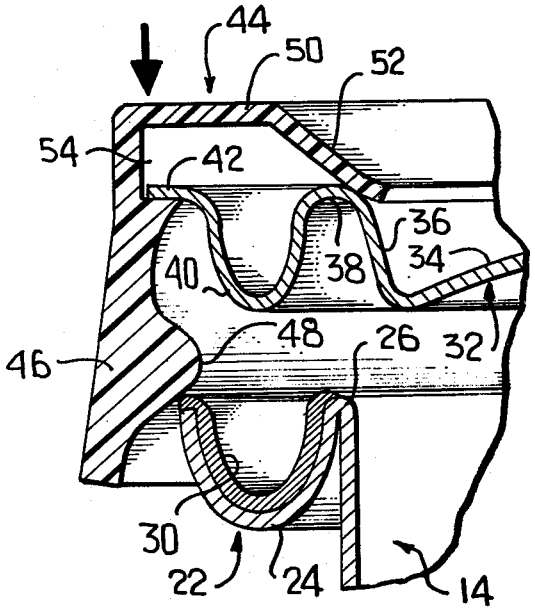
FIG.4
FIG.2
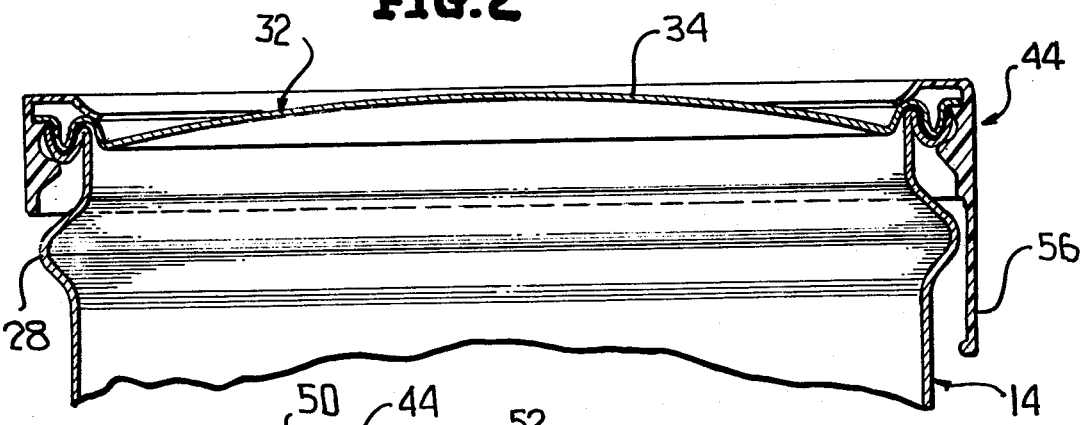
FIG.3
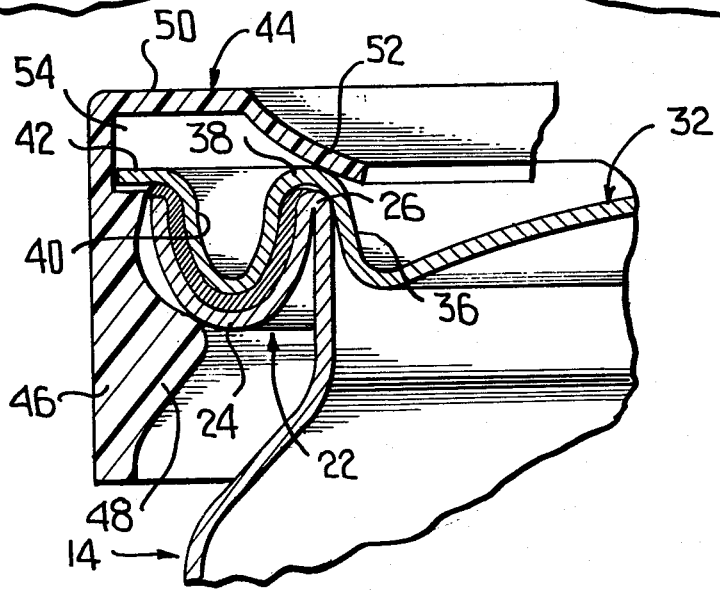

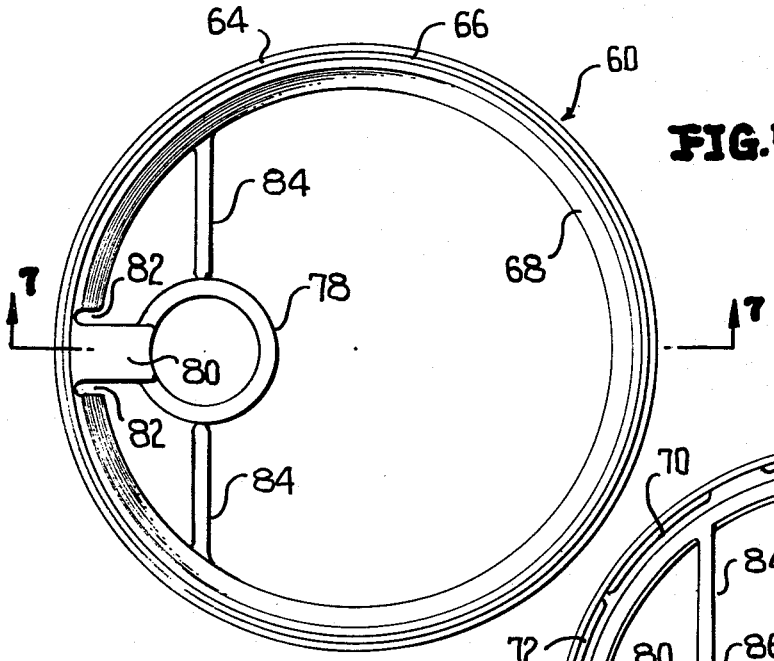
FIG.5
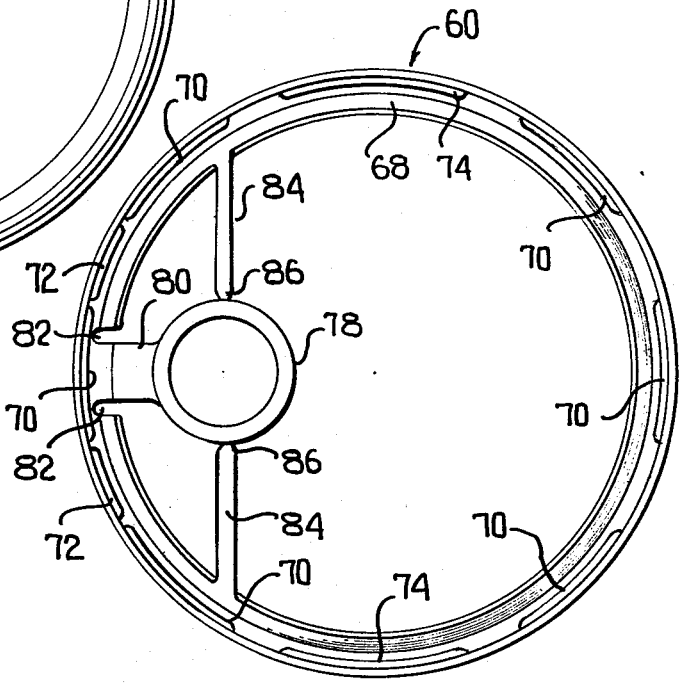
FIG.6
FIG.7
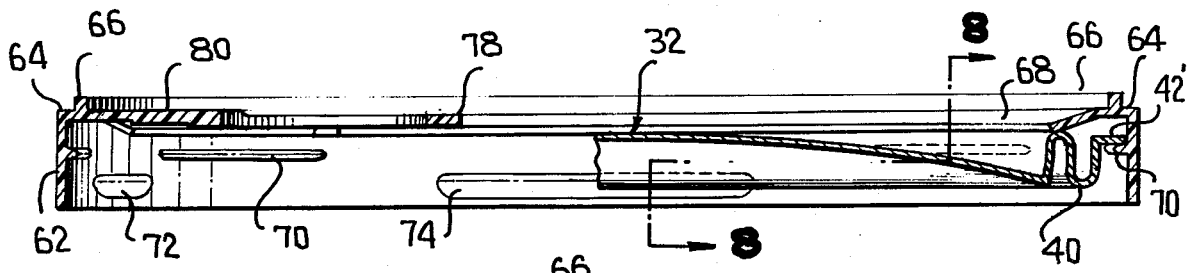
FIG.8
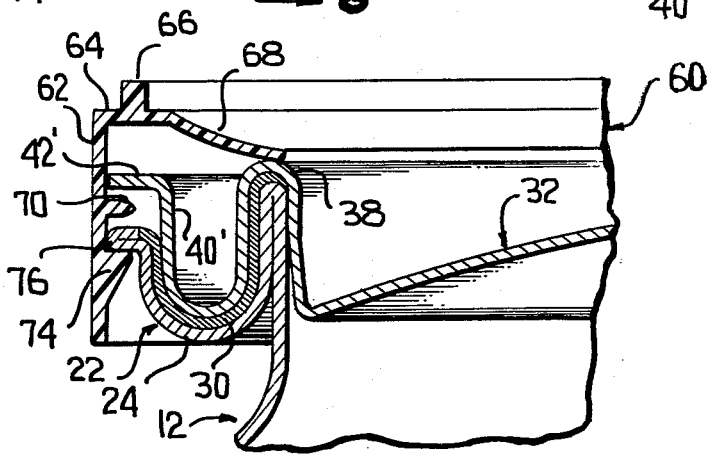

RECLOSABLE VACUUM CONTAINER

This invention relates in general to new and useful improvements in containers, and more particularly to a container which is suitable for the vacuum packaging of products and is readily openable and reclosable.

This invention is primarily directed to the provision of a safe, low cost, reclosable container in which a food or like product may be readily packed under vacuum and which has a reclosable closure member suitable for the effective storage of unused portions of the packed product.

The container is intended to be a substitute for more costly glass containers and yet have all of the benefits thereof. Known similar containers utilize glass in the formation of the container body and are unacceptable for many uses. Those prior patents known are: Ashby Pat. No. 360,131; Mackin Pat. No. 1,010,285; and Powalowski et al Pat. No. 3,460,701.

In accordance with this invention, it is proposed to provide a container body which is formed of sheet material in the same manner as a conventional can and which may, if desired, include a separately formed bottom end unit. The container body may also be formed of a sheet material and have a side seam. The container body beneficially includes a peripheral finish which defines an open end thereof with the peripheral finish defining a continuous sealing cavity and being preferably of a U-shaped configuration. The sealing cavity is provided with a gasket which is preferably formed in situ and of a flowable material so as to compensate for any irregularities in the surface of the sealing cavity including a portion of a side seam which may extend across the sealing cavity.

The container is also provided with a closure member preferably in the form of a sheet metal end unit which has a peripheral portion shaped to define a depending rib seatable in the sealing cavity on the gasket. The closure member is retained in place by a retaining ring which is preferably formed of a resilient, deformable material, such as a plastics material, which is placed under tension in the sealed condition of the container.

The container will have sufficient strength to permit vacuum packaging thereof so as to be suitable for conventionally vacuum packed products such as nuts, etc., and is readily resealable by applying the closure member and locking it in place utilizing the retaining ring. The retaining ring may be permanently interlocked with the closure member so that the two may be handled as a unit.

By mounting the gasket within the cavity, the gasket is protected at all times and therefore is not subject to the usual damage that may occur when the gasket is carried by the closure member as it is in the case of many resealable containers employing gaskets.

Another feature of the invention is to form the retaining ring with a pull ring which is disposed on top of the cover. By so placing the pull ring, a leverage action is obtained which facilitates the removal of the retaining ring.

With the above and other objects in view that will hereinafter appear, the nature of the invention will be more clearly understood by reference to the following detailed description, the appended claims, and the several views illustrated in the accompanying drawing.

IN THE DRAWINGS

FIG. 1 is a top perspective view of a container formed in accordance with this invention.

FIG. 2 is an enlarged fragmentary vertical sectional view taken along the line 2—2 of FIG. 1, and shows the specific details of the closure and the relationship thereof to the container body.

FIG. 3 is an enlarged fragmentary sectional view showing more specifically the details of the container body, the closure member, and the retaining ring in their assembled relation.

FIG. 4 is an enlarged fragmentary sectional view similar to FIG. 3 and shows the container in the process of being reclosed.

FIG. 5 is a top plan view of a modified form of retaining ring and shows generally the details thereof.

FIG. 6 is a bottom plan view of the retaining ring of FIG. 5.

FIG. 7 is an enlarged transverse vertical sectional view taken along the line 7—7 of FIG. 5 and shows specifically the details of the retaining ring.

FIG. 8 is an enlarged fragmentary sectional view taken through a container formed in accordance with this invention and having incorporated therein the retaining ring of FIGS. 5–7.

Referring now to FIGS. 1–4 of the drawings in deatil, it will be seen that the container is generally identified by the numeral 10 and includes a container body generally identified by the numeral 12. In the illustrated form the container body 12 is of a two-piece construction and includes a body member, generally identified by the numeral 14, and a bottom end unit 16 secured thereto in a conventional manner by means of a seam 18. The body member 14 is formed of sheet metal and has a conventional side seam 20. However, the container body 12 could be of a one-piece construction.

In accordance with this invention, the upper end of the container body includes a peripheral finish 22 which is in the form of a U-shaped cross sectional portion 24 connected to an adjacent portoin of the body member 14 by a reverse bend or fold 26. It is also to be noted that the upper portion of the container body 12 includes an outwardly directed bead 28.

The peripheral finish 22, which defines a continuous sealing cavity, has a lining in the form of a sealing gasket 30. The sealing gasket 30 is preferably formed with a liquid compound or gasket material which is flowed into the sealing cavity and is cured in place. In this manner any irregularities in the surface of the sealing cavity are compensated for and the gasket 30 will have a smooth continuous upper surface.

The container 10 includes a closure member 32 which is in the form of a sheet metal end unit. The closure member 32 includes an end panel 34 defined by an upstanding wall 36. Outwardly of the wall 36 the closure member 32 is reversely turned as at 38 and then shaped to define a U-shaped cross sectional downwardly projecting rib 40. Outwardly of the rib 40 the closure member 32 terminates in a peripheral flange 42. It may be seen that the reversely turned portion 38 is of a size and portion to receive the reversely turned portion 26 and the adjacent part of the gasket 30 while the rib 40 is of a size and portion to be firmly seated within the gasket 30 which is also of a U-shaped configuration. The flange 42 extends outwardly of the peripheral finish 22.

The container 10 further includes a retaining ring, generally identified by the numeral 44. The retaining ring 44 is formed of a resilient deformable material, and it has been found that many plastics materials will suffice. The retaining ring 44 includes a skirt 46 which is configurated to define a projection 48 which underlies the peripheral finish 22, which is in the form of a shoulder, and thus retains the retaining ring 44 in place. The retaining ring 44 also includes an upper inwardly directed annular flange 50 which has a downwardly sloping inner portion 52 which engages the reversely turned portion 38 firmly to clamp the closure member 32 in place relative to the container body 10. It is to be understood that when the retaining ring 44 is in place, it will be in tension and the flange portion 52 will be slightly deflected as shown in FIG. 3.

It is to be noted that the retaining ring 44 has the upper part of the skirt 46 so configurated as to define an annular cavity 54 in which the peripheral flange 42 of the closure member 32 is trapped. Thus, the closure member 32 is removed from the container body 12 together with the retaining ring 44.

In order to facilitate removal of the retaining ring 44, the skirt 46 thereof may be provided with a depending tab 56 shown in FIG. 1. By pulling upwardly and outwardly on the tab 56, the retaining ring 44 may be progressively removed from the container body 12.

After a portion of the contents of the container 10 has been removed, the container may be reclosed by merely forcing the retaining ring 44 downwardly relative to the container body 12 as is shown in FIG. 4.

It will be readily apparent that inasmuch as the gasket 30 remains bonded to the container body 12 and is protected by the channel-shaped configuration of the peripheral finish 22, no problem of damaging of the gasket 30 will occur as is the usual case where the gasket is formed on the underside of the end unit or closure member.

Referring now to FIGS. 5–7, it will be seen that there is illustrated a modified form of retaining ring which is generally identified by the numeral 60. The retaining ring 60 is preferably formed of a suitable plastics material and includes a cylindrical skirt 62 and an annular flange 64 integrally formed with the upper edge of the skirt 62. The annular flange 64 is reinforced or stiffened by an upstanding rib 66. An annular lip 68 extends inwardly and downwardly from the inner edge of the flange 64.

In order that the cover 32 may be retained with the retaining ring 60 at all times, the inner upper surface of the skirt 62 is provided with a plurality of retaining ribs 70 which lie in a single plane. Although the ribs 70 have been illustrated as being spaced, it is to be understood that the ribs 70 could be continuous if desired.

It is also to be noted that the lower part of the inner surface of the skirt 62 is provided with a plurality of spaced locking ribs 72 and 74. It is to be noted that the ribs 72 are relatively short while the ribs 74 are relatively long.

In order to receive the retainer 60, it is necessary that the container body 12 be slightly modified. Most particularly, it will be seen that the U-shaped cross sectional portion 24 be provided with an outwardly projecting annular lip or flange 76 beneath which the ribs 72 and 74 may engage to hold the cover 32 in sealed engagement with the container body 12.

It is also to be understood that the cover 32 need be slightly modified so as to have a downwardly projecting rib 40′ which is slightly deeper than the rib 40, thereby elevating a terminal peripheral flange 42′ thereof with respect to the U-shaped cross sectional portion 24 and the lip or flange 76. This will provide adequate space for the ribs 70 which underlie the peripheral flange 42′ and retain the cover 12 as a unit with the retaining ring 60.

It will be readily apparent that the retaining ring 60 functions in the same manner as the retaining ring 44. When the modified cover 32 is implaced on the modified container body 12, the ribs 72, 74 engage beneath the lip 76 and the proportions of the retaining ring 60 are such that the lip 68 is compressed and deflected upwardly by its engagement with the reversely turned portion 38 of the cover 32. Thus, the retaining ring 60 serves to tightly, but resiliently, hold the rib 40′ in sealing engagement with the gasket 30 of the container body 12.

In order to facilitate removal of the retaining ring 60, the retaining ring is provided with an integrally formed pull ring 78 which is connected to the flange 64 inwardly of the rib 66 by means of a relatively stiff strap 80. It is to be noted that the lip 68 is interrupted on opposite sides of the strap 80 and is separated therefrom by notches 82.

At this time it is pointed out that the short ribs 72 are so oriented with respect to the pull ring 78 so as to be disposed on opposite sides of the strap 80, thus facilitating the removal of the retaining ring and cover when the strap 80 is pulled upwardly by the pull ring 78.

It is also pointed out here that the retaining ring 60 has a tamper indicating feature in the form of the pair of fingers 84 which extend from the lip 68 to opposite sides of the pull ring 78. The fingers 84 have relatively weak connections 86 with the pull ring 78 so that when the pull ring 78 is lifted upwardly, these connections 86 are automatically broken to indicate that the cover 32 may have been removed.

Although only a preferred embodiment of the container has been specifically illustrated and described herein, it is to be understood that minor variations may be made therein without departing from the spirit and the scope of the invention as defined by the appended claims.

I claim:

1. A reclosable container comprising a container body having an open end defined by a peripheral finish, said finish extending outwardly of an adjacent portion of said container body and defining a shoulder, said finish defining a continuous sealing cavity facing away from said shoulder, a closure member, said closure member having a peripheral depending rib seated in said sealing cavity, and a retaining ring releasably securing said closure member to said container body, said retaining ring having a flange overlying said closure member and a depending skirt surrounding said peripheral finish, said skirt including an inwardly directed projection underlying said shoulder.

2. The container of claim 1 wherein said retaining ring is formed of a resiliently deformable material and said flange and said skirt are relatively tensioned.

3. The container of claim 1 wherein said cavity carries a gasket.

4. The container of claim 1 wherein said cavity carries a gasket permanently bonded thereto.

5. The container of claim 4 wherein said gasket is in the form of a liner formed in place.

6. The container of claim 5 wherein said container body is formed of sheet material and includes a side seam.

7. The container of claim 6 wherein said formed in place gasket compensates for any unevenness due to said seam.

8. The container of claim 2 wherein said retaining ring is formed of a plastics material and has a removal facilitating tab extending down alongside said container body.

9. The container of claim 1 wherein said closure member is interlocked with said retaining ring for removal therewith as a unit.

10. The container of claim 1 wherein said peripheral finish is of a U-shaped cross-section.

11. The container of claim 1 wherein both said container body and said closure member are formed of sheet material and both said peripheral finish and said peripheral depending rib are of a U-shaped cross-section.

12. A reclosable container body having a peripheral finish defining an open end, said container body being formed of sheet material and having a side seam, said peripheral finish defining an upwardly opening sealing cavity and being of a generally U-shaped cross-section, and a formed in situ gasket in said cavity and permanently bonded to said peripheral finish.

13. The container of claim 1 wherein said retaining ring has a removal facilitating pull ring overlying said closure member.

14. The container of claim 13 wherein said retaining ring is formed of a resiliently deformable material and said flange and said skirt are relatively tensioned.

15. The container of claim 1 wherein said retaining ring has a removal facilitating pull ring overlying said closure member, said pull ring being connected to said flange.

16. The container of claim 15 wherein there are tamper indicating means connected to said pull ring.

17. The container of claim 15 wherein there are tamper indicating fingers extending between said pull ring and said flange.

18. The container of claim 15 wherein said flange includes an inner lip directly engageable with said closure member, said pull ring is connected to said flange by a strap, and said lip is interrupted and spaced from said strap.

* * * * *